US005885163A

United States Patent [19]

Bjorn et al.

[11] Patent Number: 5,885,163

[45] Date of Patent: Mar. 23, 1999

[54] CHILDREN'S ROTATING RIDING TOY

[76] Inventors: Lee Thomas Bjorn, 15690 Loma Vista Ave., Los Gatos, Calif. 95031; Rodney Reed Rainey, 1070 Westwood Dr., San Jose, Calif. 95125

[21] Appl. No.: 17,279

[22] Filed: Feb. 2, 1998

[51] Int. Cl.[6] ..... A63G 1/20

[52] U.S. Cl. ..... 472/5; 472/108

[58] Field of Search ..... 472/106, 108, 472/109, 112, 115, 4, 120, 121; 482/95, 96, 72

[56] References Cited

U.S. PATENT DOCUMENTS

| | | | |
|---|---|---|---|
| 1,552,841 | 9/1925 | Hector | 472/106 |
| 2,544,589 | 3/1951 | Cummings | 472/106 |
| 3,614,096 | 10/1971 | Ely | 472/106 |
| 4,641,833 | 2/1987 | Trethewey | 482/95 |
| 5,403,239 | 4/1995 | Zimmers | 472/106 |
| 5,529,557 | 6/1996 | Barton | 482/95 |

*Primary Examiner*—Kien T. Nguyen

[57] ABSTRACT

A rotating riding toy for children has adjustability in the linkage which causes the riding toy to rotate. It has been found that such adjustability can affect the ease of pumping or driving the riding toy rotationally as well as the rotational speed obtained. In addition, the seats are positionally adjustable to accommodate smaller and larger children. Quick release pins are envisioned for removing stabilizing legs from a base member to afford breakdown of the mechanism and portability.

8 Claims, 3 Drawing Sheets

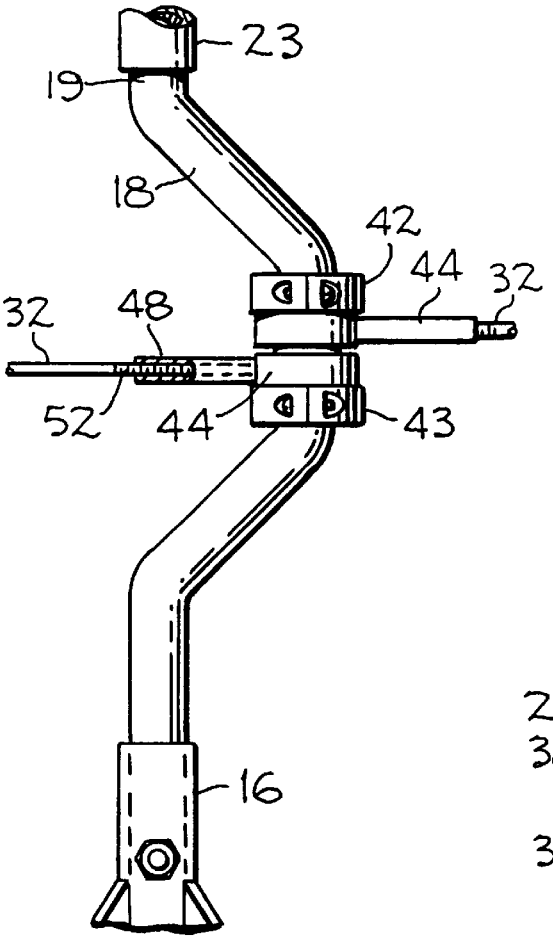
fig_2
fig_3
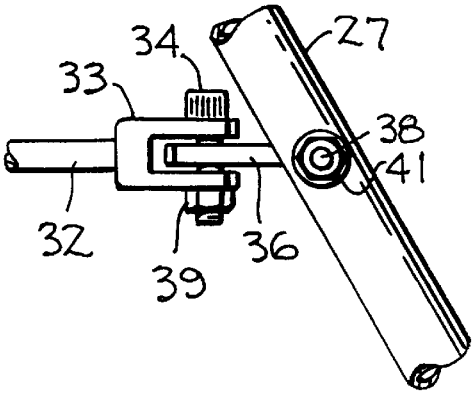
fig_4
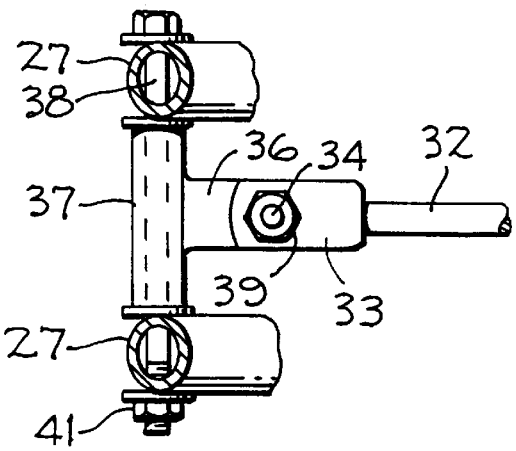
fig_5
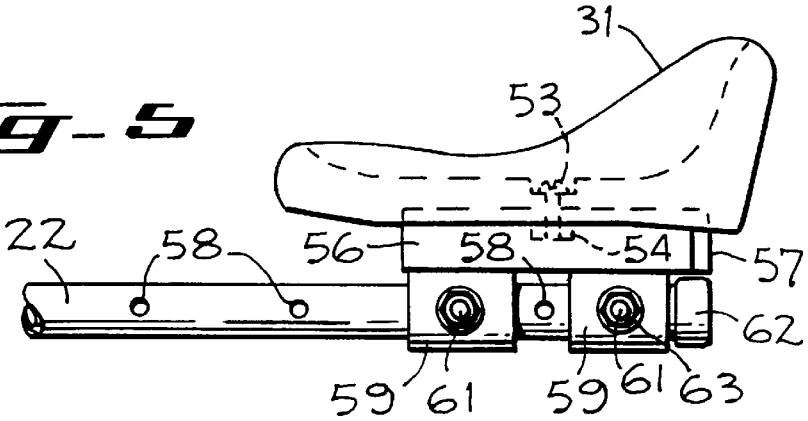

fig_6
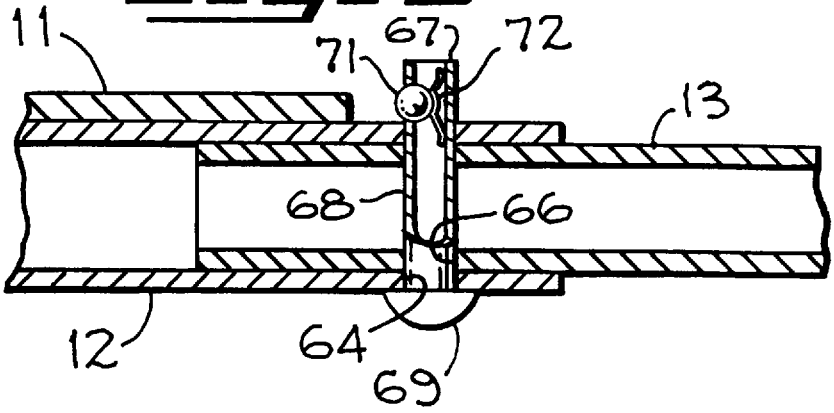
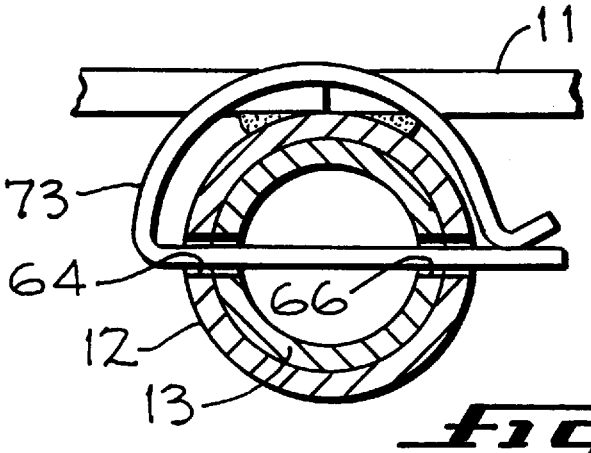
fig_7
fig_8
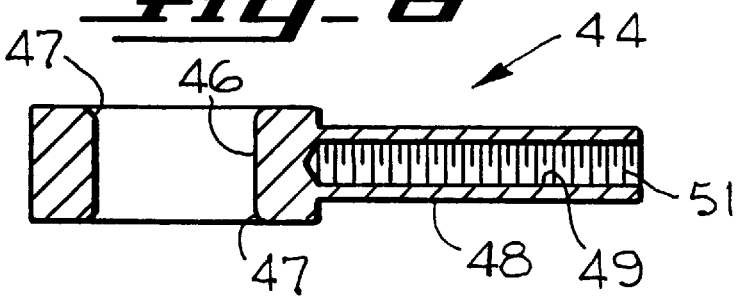

CHILDREN'S ROTATING RIDING TOY

SUMMARY OF THE INVENTION

A children's rotating riding toy has a base, a plurality of stabilizing legs attached to and extending outwardly from the base and an upwardly extending receiver attached to the base. A crank member is fixed at a lower end in the receiver and has an upper end extending upwardly therefrom. A frame has opposing free ends, wherein the frame is mounted for rotation on the upper end of the crank member. Seat means is attached to each of the opposing free ends of the frame and pumping means is mounted to the frame within manual reach of each of the seat means. Pivot means is provided for attaching the pumping means to the frame together with pumping link means pivotally attached to the pumping means at a point spaced from the pivot means at one end thereof and to said crank at an opposite end. Means is provided for adjusting the length of the pumping link means thereby providing adjustment of pumping mechanical advantage and subsequent riding toy rotational speed.

BRIEF DESCRIPTION OF THE DRAWINGS

FIG. 2 is a detail of the crank utilized in the present invention.

FIG. 3 is a section along the line 3—3 of FIG. 1.

FIG. 4 is a section along the line 4—4 of FIG. 1.

FIG. 5 is an elevation taken along the line 5—5 of FIG. 1.

FIG. 6 is a section along the line 6—6 of FIG. 1.

FIG. 7 is a section along the line 7—7 of FIG. 1 showing an alternative quick disconnect in the present invention.

FIG. 8 is a section along the length of one configuration of the link retainer used in the present invention.

DESCRIPTION OF THE PREFERRED EMBODIMENTS

Figure 1:
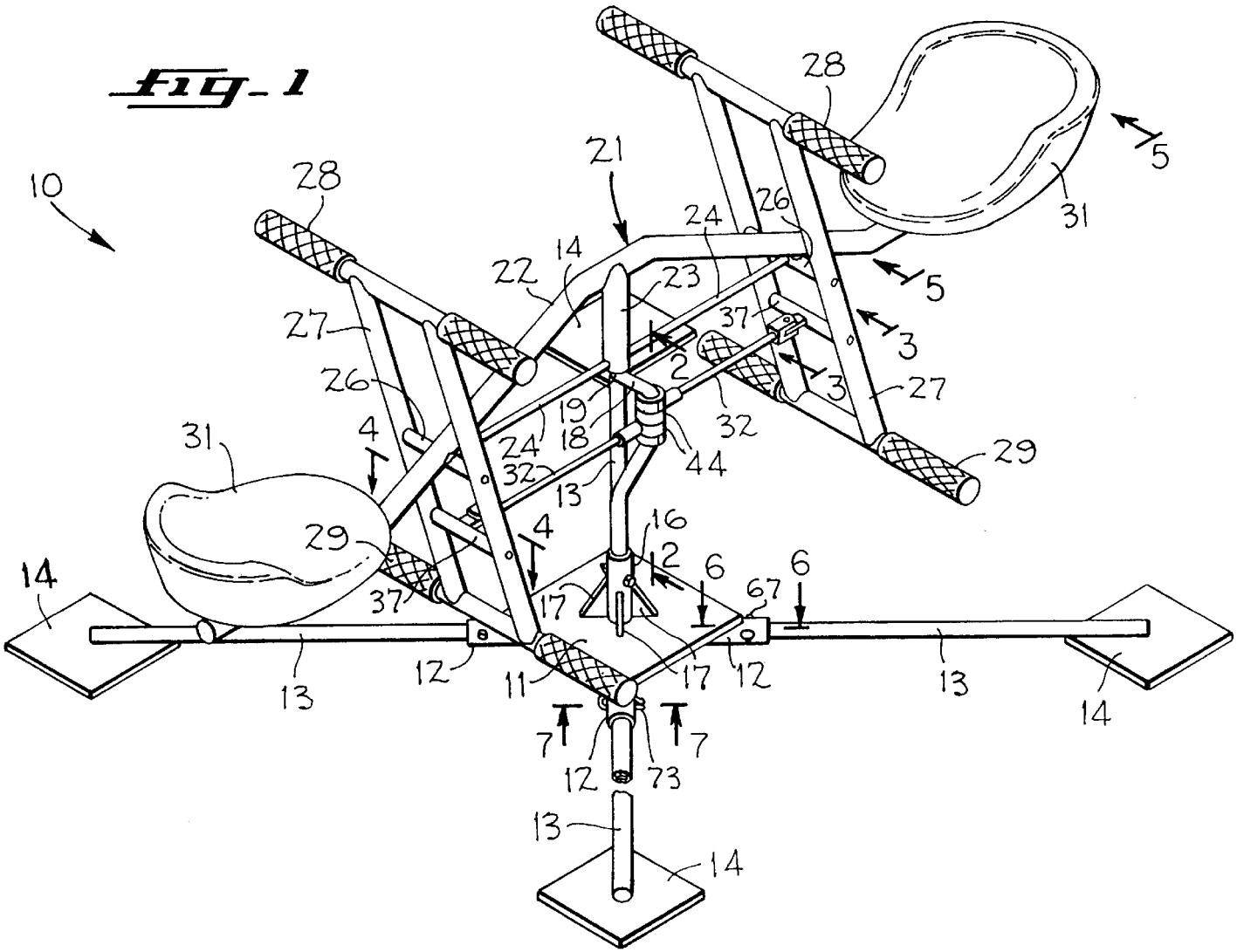
FIG. 1 is a perspective of the children's rotating riding toy of the present invention.

A children's rotating riding toy is known wherein a base is stabilized by a plurality of laterally extending legs which are attached to the base. A tubular receiver extends upwardly and is attached to the base. A crank member is fixed in the tubular receiver, having an upper end which extends above the eccentric portion of the crank member. A frame is mounted for rotation on the upper end of the crank member, wherein the frame has a seat attached to outwardly extending portions of the frame. Pumping handles are mounted on the frame on frame pivots, the pumping handles being within manual reach of each of the seats. A pumping link extends from a point on the pumping handles spaced from the frame pivots. Opposing ends of the pumping links are attached to the crank member. As a result, when the pumping handles are moved back and forth about the frame pivots, the pumping links cooperate with the crank causing the frame to rotate about the upper end of the crank member.

The children's rotating riding toy 10 of the present invention may be seen in the drawing FIG. 1, wherein base 11 is formed from a square of steel plate (i.e., ¼ inch steel), having tubular members 12 welded to the bottom of the square steel plate and extending radially from the corners thereof. The inside diameters of the tubes 12 welded to the underside of the base 11 are about 1–⅛ inches. Four legs 13 having an outside diameter which fit within the inside diameters of the tubes 12 and each being about 28 inches long are provided to extend outwardly from the base 11 to thereby provide four stabilizing leg members. The outer ends of the leg members 13 have square steel plate pads 14 about 4"×4" welded to the underside of the ends of the legs 13 as seen in FIG. 1. The legs 13 are held within the tubes 12 by a removable fastener extending through aligned holes in the tube 12 and the leg 13 as will hereinafter be explained.

Attached to the upper side of the base 11 is a tubular upwardly extending receiver 16 having reinforcing gussets 17 which support the receiver in the center portion of the base 11. The receiver 16 is tubular having an inside diameter which accommodates the lower end of a crank member 18 having about a 2–½ inch offset from the longitudinal axis running through the lower end of the crank member and an upper end 19 of the crank member. A frame 21 has an upwardly-arched mainframe member 22 and a downwardly extending tubular portion 23 which is formed to fit over the upper end 19 of the crank member 18 to be journaled thereupon. Two horizontally extending brace members 24 are fastened to opposing sides of the downwardly extending tubular member 23 at one end and to the upwardly arched mainframe member 22 at the other as seen in FIG. 1. A pair of pivot tubes 26 are also attached to the upwardly arched mainframe member 22 at the points on the mainframe member where the horizontally extending braces 24 are attached. The pivot tubes 26 receive pivot pins therethrough and define pivot points for a pair of pump handles 27 having upper manually engagable handles 28 and lower footrests 29. A seat 31 is attached to the opposing ends of the upwardly-arched mainframe member 22 in a manner to be hereinafter described.

A pair of pumping links 32 are pivotally attached to the pumping handles 27 at a point on the pumping handles spaced from and below the pivot tubes 26. As seen in FIG. 3 of the drawings the pumping link 32 is terminated at the pumping handle end in a fork 33. FIG. 3, taken in conjunction with FIG. 4, shows a bolt 34 extending through aligned holes through the two shown arms of the fork 33. The bolt 34 also extends through a hole in a tongue portion 36 of a pivot tube 37 which extends between the two upright members of the pump handle 27 as shown in FIG. 1. The pivot tube 37 receives a pumping link pin 38 which extends therethrough and which also extends through aligned holes in the upright members of the pumping handle 27 as seen in FIG. 4. The bolt 34 is secured within the fork 33 thereby capturing the tongue 36 by means of a nut 39 (FIG. 3). The pumping handle pivot pin 38 is secured in the position as shown in FIG. 4 by the nut 41.

Turning now to FIG. 2 of the drawings, the opposite end of the pumping link 32 is seen as it is rotatably attached to the crank member 18. The crank member 18 is preferably formed as a bent member as seen in FIG. 2 with the offset or eccentric portion of the crank displaced from a longitudinal axis through the lower end of the crank and the upper end 19 of the crank by about 2–½ inches. The angles of bend which produce the offset are preferably about 45 degrees from the longitudinal axis through the upper and lower ends of the crank. The offset portion of the crank 18 is sufficiently long to receive an upper split ring 42, a lower split ring 43, and two link retainer members 44 which are attached to the crank ends of the pumping links 32. The link retainer member is seen in section in FIG. 8 having a hole 46 therethrough for surrounding the offset or eccentric crank 18. It should be noted with reference to FIG. 8 that the hole 46 has upper and lower rounded edges 47 which facilitate slipping the link retainer 44 over either end of the crank member 18 and past the rounded portions thereon. The rounded corners at the bends on the crank 18 and the rounded upper and lower edges 47 of the hole 46 on the link retainer 44 are therefore fashioned to allow the link member to be readily assembled onto the offset portion of the crank 18. Link retainers 44 are then captured in place at the offset portion of the crank by the upper and lower split rings 42 and 43 which are fixed in place on the crank 18 using fasteners to hold the two halves of the split rings together in a known fashion. The link retainer 44 also has an extending arm 48 (FIG. 8) which has a bore 49 therein and internal threads 51 on the inside diameter of the bore 49. The pumping link 32 has external threads 52 thereon (FIG. 2) which mate with the internal threads 51 in the link retainer. The length of the pumping link 32 is determined by the amount of engagement between the threads 52 on the pumping link and the internal threads 51 within the link retainer. The pumping link length may be adjusted by removing the nut 39 from the bolt 34 (FIG. 3) and turning the pumping link 32 to engage more or fewer of the threads 51 with the pumping link threads 52 and thereafter reinserting the bolt 34 as hereinbefore described and replacing the nut 39 on the end of the bolt 34. It has been found empirically that lengthening the pumping link 32 provides a mechanical advantage which allows easier pumping of the rotating riding toy and faster rotational speeds.

With reference now to FIG. 5, seat 31 is shown attached (in hidden line) by a bolt 53 and a nut 54 to a channel section 56. Channel section 56 fits within a slot formed in the bottom of the seat 31. It is envisioned that a plug 57 will be inserted in the open end of the channel 56. A series of aligned holes 58 are formed through and near the free ends of the tubular upwardly-arched mainframe member 22 as seen in FIG. 5. A pair of tubular brackets 59 are attached to and extend below the channel section 56 which supports the seat 31. A desired position for the seat 31 relative to the free end of the upwardly-arched mainframe member 22 is selected wherein a pair of holes 58 are positioned in registration with a pair of through holes through the underlying brackets 59 attached to the seat 31. In this fashion, two of the aligned holes 58 will accept pins therethrough which also will pass through holes in the tubular brackets 59. Such pins, seen as items 61 in FIG. 5, are held in place by means of threaded nuts 62, the ends of the pins 61 being threaded. Alternative means of securing the pins 61 in place are envisioned. It may be seen therefore that the position of the seat 31 is adjustable relative to the free end of the main frame member 22 by selecting a pair of the holes 58 through the main frame member and aligning the holes in the tubular members 59 therewith and subsequently pinning the tubular members 59 in place. Such adjustment of the seat 31 relative to the main frame member 22 will accommodate smaller or larger children on the rotating riding toy according to where it is adjustably positioned along the main frame member.

With reference now to FIG. 6 of the drawings a section is taken through the tubular member 12 attached to the bottom surface of the base 11. Also shown is a leg 13 inserted within the inside diameter of the tubular portion 12. A through hole 64 in the base mounted tubular section 12 is aligned with a through hole 66 in the portion of the leg 13 entered into the inside diameter of the tubular section 12 and a quick removal pin 67 is inserted therethrough to fix the leg 13 within the tubular section 12. As seen in FIG. 6, quick removal pin 67 has a hollow shank 68 and a rounded head 69 at one end. Near the end of the hollow shank away from the rounded head 69 a hole is formed in the wall of the hollow shank 68 and a ball 71 is allowed to protrude through the hole. The ball is forced to protrude through the hole by a leaf spring 72 within the hollow shank. The ball is captured within the hollow shank between the leaf spring and the undersize hole through which the ball protrudes, so that it retains the pin 67 within the aligned holes 64 and 66 during normal use. Axial force on the pin 67 for either inserting the pin within the aligned 64 and 66 or removing it therefrom will cause the ball 71 to be depressed against the spring 72 by contact with the edges of the aligned holes so that the pin may be inserted or removed at will so that the leg 13 may either be retained in operating position or removed in the event it is desired to render the rotating riding toy portable.

An alternative to the pin 67 of FIG. 6 is seen in the section of FIG. 7 in the drawings. As described hereinbefore for the embodiment of FIG. 6, aligned holes 64 and 66 are formed in the walls of the tubular section 12 and the leg 13. With the holes 64 and 66 in alignment, a snap pin 73 may have the straight portion thereof thrust through the aligned holes and the pin 73 will be held in place as shown in FIG. 7. Further, it may be seen that removal of the pin 73 from the aligned holes is obtained by merely grasping the pin and pulling the pin out of the aligned holes against the spring action of the contacting or "snap" portion of the pin 73. In this fashion, the legs 13 may be assembled within the tubular sections 12 attached to the base 11 or they may be removed therefrom for affording portability to the rotating riding toy.

It may be seen from the foregoing that a child's rotating riding toy is described herein which affords adjustable pumping action, adjustable seat positioning, and quick breakdown of the base and the stabilizing legs for portability.

Although the best mode contemplated for carrying out the present invention has been shown and described herein, it will be understood that modification and variation may be made without departing from what is regarded to be the subject matter of the invention.

What is claimed:

1. A children's rotating riding toy, comprising a base, a plurality of stabilizing legs attached to and extending outwardly from said base, an upwardly extending receiver attached to said base, a crank member fixed at a lower end in said receiver and having an upper end extending upwardly therefrom, a frame having opposing free ends, said frame being mounted for rotation on said crank member upper end, seat means attached to each of said opposing free ends of said frame, pumping means mounted to said frame within manual reach of each of said seat means, pivot means for attaching said pumping means to said frame, pumping link means pivotally attached to said pumping means at a point spaced from said pivot means at one end thereof and to said crank at an opposite end, and means for adjusting the length of said pumping link means for providing to adjustment of pumping mechanical advantage and subsequent riding toy rotational speed.

2. The children's rotating riding toy of claim 1, comprising means for adjusting the position of said seat means relative to said frame opposing free ends, whereby children of various physical sizes are accommodated.

3. The children's rotating riding toy of claim 1, wherein said means for adjusting the length of said pumping link means comprises a link retainer at said opposite end of said pumping link means and a link member extending between said pumping link means one end and said link retainer, said link retainer having one end configured to surround said crank member and an opposing end configured to receive one end of said link member, and means for adjustably retaining said link member at said link retainer opposing end.

4. The children's rotating riding toy of claim 3, wherein said means for adjustably retaining comprises mating threads formed on said link retainer opposing end and said one end of said link member.

5. The children's rotating riding toy of claim 1 comprising quick release means for attaching said plurality of stabilizing legs to said base.

6. In a children's rotating riding toy having a base, a plurality of stabilizing legs extending outwardly from said base, an upwardly extending receiver attached to said base, a crank member fixed in said receiver at a lower end and having an upwardly extending free end, a frame having opposing free ends and being mounted for rotational movement on said crank free end, a seat attached near each of said frame opposing free ends, a pumping handle pivotally attached to said frame within manual reach of said seat, and a pumping link pivotally attached to said pumping handle and spaced from said frame at one end and to said crank at an opposite end, the improvement comprising means for adjusting the length of said pumping link thereby providing adjustment of pumping mechanical advantage and subsequent riding toy rotational speed.

7. In the children's rotating riding toy of claim 6, the further improvement comprising means for adjusting the position of said seat relative to said frame opposing free ends, whereby children of different physical sizes are accommodated.

8. In the children's rotating riding to of claim 6, the further improvement comprising quick release means for attaching said plurality of stabilizing legs to said base.

* * * * *